US008187037B2

(12) United States Patent
Mo

(10) Patent No.: US 8,187,037 B2
(45) Date of Patent: May 29, 2012

(54) ELECTRONIC SIGNAL CONNECTOR HAVING A FILTER MODULE, METHOD FOR FABRICATING FILTER MODULE FOR ELECTRONIC SIGNAL CONNECTOR

(75) Inventor: Chia-Ping Mo, Keelung (TW)

(73) Assignee: Ajoho Enterprise Co., Ltd., Taipei (TW)

( * ) Notice: Subject to any disclaimer, the term of this patent is extended or adjusted under 35 U.S.C. 154(b) by 0 days.

(21) Appl. No.: 13/158,876

(22) Filed: Jun. 13, 2011

(65) Prior Publication Data

US 2011/0237130 A1 Sep. 29, 2011

(30) Foreign Application Priority Data

Feb. 1, 2011 (TW) ..... 100103832

(51) Int. Cl.
*H01R 13/66* (2006.01)

(52) U.S. Cl. ..... 439/620.07

(58) Field of Classification Search ..... 439/620.07, 439/620.06, 620.11, 620.18, 620.23
See application file for complete search history.

(56) References Cited

U.S. PATENT DOCUMENTS

| | | | | |
|---|---|---|---|---|
| 6,102,741 | A * | 8/2000 | Boutros et al. | 439/620.06 |
| 6,811,442 | B1 * | 11/2004 | Lien et al. | 439/620.07 |
| 6,835,098 | B1 * | 12/2004 | Chang | 439/620.06 |
| 2002/0086584 | A1 * | 7/2002 | Liu | 439/620 |
| 2011/0237130 | A1 * | 9/2011 | Mo | 439/620.07 |

* cited by examiner

*Primary Examiner* — Phuong Dinh
(74) *Attorney, Agent, or Firm* — Muncy, Geissler, Olds & Lowe, PLLC

(57) ABSTRACT

An electronic signal connector includes an electrically insulative housing, metal abutting contacts and metal transmission contacts arranged in front and rear sides in the electrically insulative housing, and a filter module, which includes two symmetric flat substrates electrically connected between the metal abutting contacts and the metal transmission contacts and a metal core set between two electrically connected sets of radially arranged metal wire conductors in an induction zone at the flat substrates to provide a continuous winding type metal magnetic coil inductive effect.

13 Claims, 12 Drawing Sheets

ELECTRONIC SIGNAL CONNECTOR HAVING A FILTER MODULE, METHOD FOR FABRICATING FILTER MODULE FOR ELECTRONIC SIGNAL CONNECTOR

This application claims the priority benefit of Republic of China patent application number 100103832, filed on Feb. 1, 2011.

BACKGROUND OF THE INVENTION

1. Field of the Invention

The present invention relates to electronic connectors and more particularly, to an electronic signal connector equipped with a low-profile filter module and practical for use in an electronic product having light, thin, short and small characteristics.

2. Description of the Related Art

Following fast development of computer technology, many advanced, high-speed. Small-size personal computers and notebook computers have been created and have appeared on the market. Further, network communication technology has been rapidly developing, bringing people's daily lifestyle and learning, working and recreational activities to a new state. By means of the internet, people at remote locations can communicate with each other conveniently. The internet enables people to transmit data, message and information at a remote place, to make a real-time communication or to play network games. Nowadays, many people daily maintain an intimate relationship with the internet.

Computer connectable networks include LAN (Local Area Network, Metro Ethernet, WAN (Wide Area Network), wireless network, intranet, and etc. When performing a network signal connection, file upload or file download transmission operation, the transmission may be interfered by internal surge or surrounding signals or magnetic noses, causing transmission instability. To avoid this problem, a filter device may be installed in the network connector to remove noises from the transmitting signal.

FIGS. 10~12 illustrate a conventional electronic signal connector and a filter module used in such an electronic signal connector. According to this design, the electronic signal connector comprises an electrically insulative housing A defining therein a receiving chamber A0, a circuit board A2 mounted inside the electrically insulative housing A, a set of metal contacts A1 bonded to the circuit board A2 and suspending in the receiving chamber A0, and a filter module B electrically connected to the circuit board A2. The filter module B comprises a plurality of iron cores B1, and a coil B11 wound round each iron core B1. This design of electronic signal connector has drawbacks as follows:

1. The filter module B requires much installation space. In order to secure the filter module B in place, an extra shell A3 is attached to the bottom side of the electrically insulative housing A, increasing the dimension of the electronic signal connector and complicating its fabrication.
2. Winding an enabled wire on each iron core B1 to form a coil B11 requires much labor and occupies much installation space. Further, the coils B11 may interfere with one another.
3. The lead ends of the coils B11 of the filter module B are arranged in different directions and electrically connected to respective metal contacts at the circuit board A2. Further, the coils B11 are kept close to one another, affecting filtering functioning among the iron cores B1.

Therefore, it is desirable to provide an electronic signal connector with a filter module for electronic signal connector that eliminates the drawbacks of the aforesaid prior art design.

SUMMARY OF THE INVENTION

The present invention has been accomplished under the circumstances in view. It is one object of the present invention to provide an electronic signal connector, which uses a low-profile filter module for removing noises, having the advantage of space saving and high signal transmission stability and reliability.

To achieve this and other objects of the present invention, an electronic signal connector comprises an electrically insulative housing, metal abutting contacts and metal transmission contacts arranged in front and rear sides in the electrically insulative housing, and a filter module, which comprises two symmetric flat substrates electrically connected between the metal abutting contacts and the metal transmission contacts and a metal core set between two electrically connected sets of radially arranged metal wire conductors in an induction zone at the flat substrates to provide a continuous winding type metal magnetic coil inductive effect.

Further, the invention employs a PC board manufacturing process including hole drilling, image transfer, plating, etching, anti-soldering and/or surface treatment steps to form metal wire conductors in an inner surface of each of the two flat substrates subject to a predetermined radially extended pattern for enabling an induction zone to be defined within the two flat substrates corresponding to the metal wire conductors, and also to form a circuit layout consisting of different electronic components, filter elements, metal input contacts and metal output contacts in an outer surface of each flat substrate subject to a predetermined circuit layout pattern. Thus, the filter module has a low profile characteristic, and provides a continuous winding type metal magnetic coil inductive effect to enhance rectifying and filtering performance.

Further, during the fabrication of the filter module, a solder material is applied to a connection contact at each of two opposing ends of each metal wire conductor of the flat substrates to electrically connect the metal wire conductors at one flat substrate with the metal wire conductors at the other flat substrate into two series, enabling the metal wire conductors to provide a continuous winding type metal magnetic coil inductive effect. Further, each flat substrate defines opposing input side and output side at the outer surface thereof opposite to the induction zone between the two flat substrates.

Further, the metal core can be an iron based, iron-nickel based or cobalt based non-crystalline alloy, or an iron based bulk nanocrystalline alloy the shape of an annular, rectangular or polygonal multilateral open frame.

DETAILED DESCRIPTION OF THE PREFERRED EMBODIMENT

Figure 1:
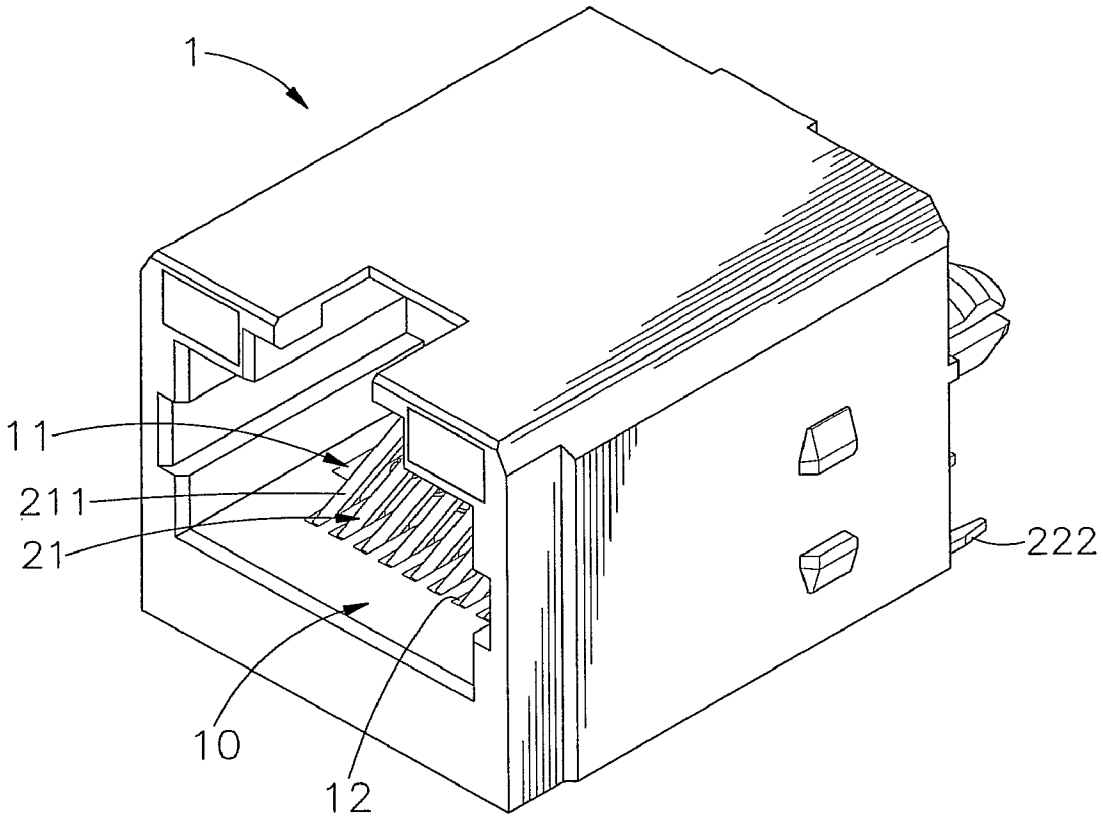
FIG. 1 is an elevational view of an electronic signal connector in accordance with the present invention.
Figure 2:
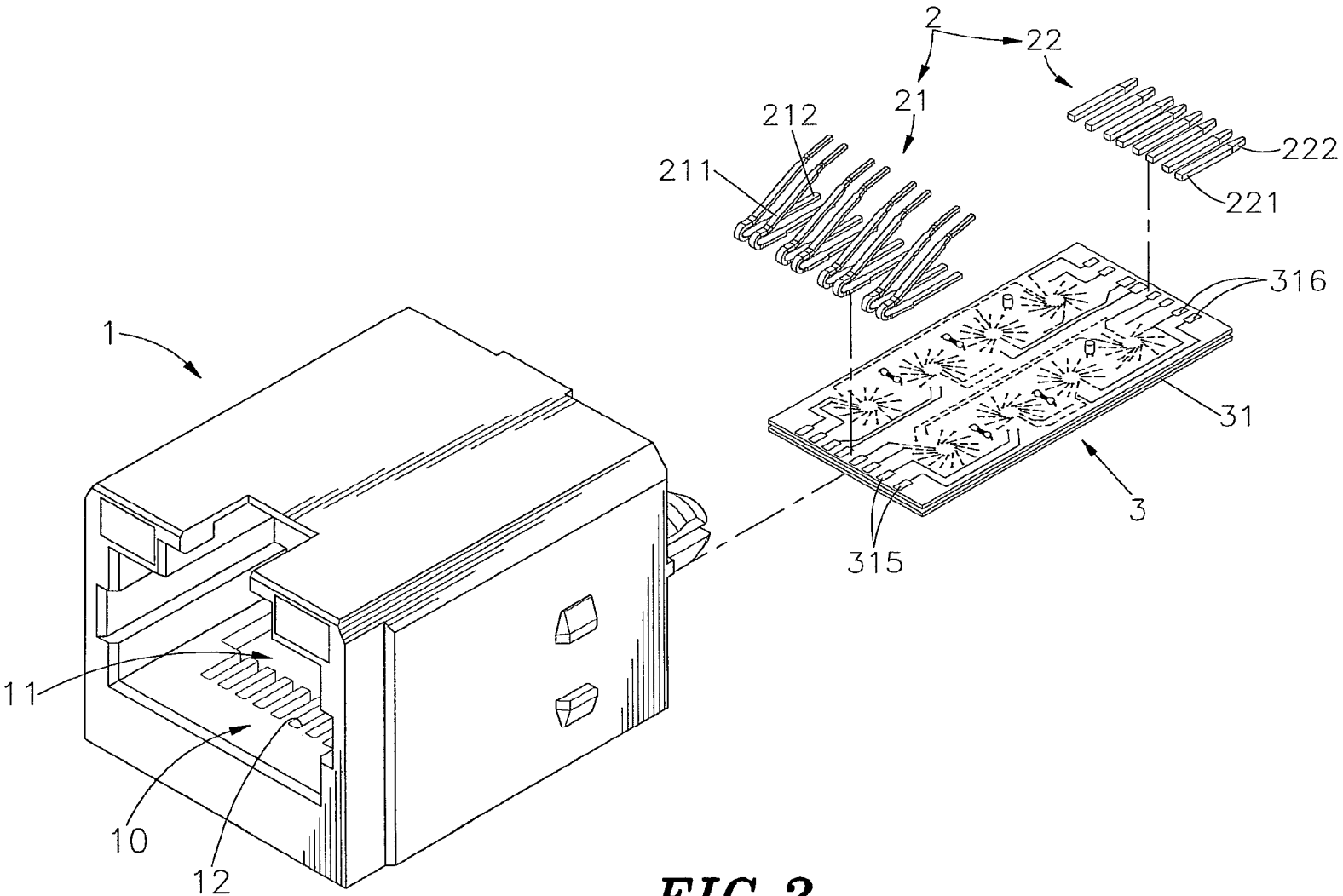
FIG. 2 is an exploded view of the electronic signal connector in accordance with the present invention.
Figure 3:
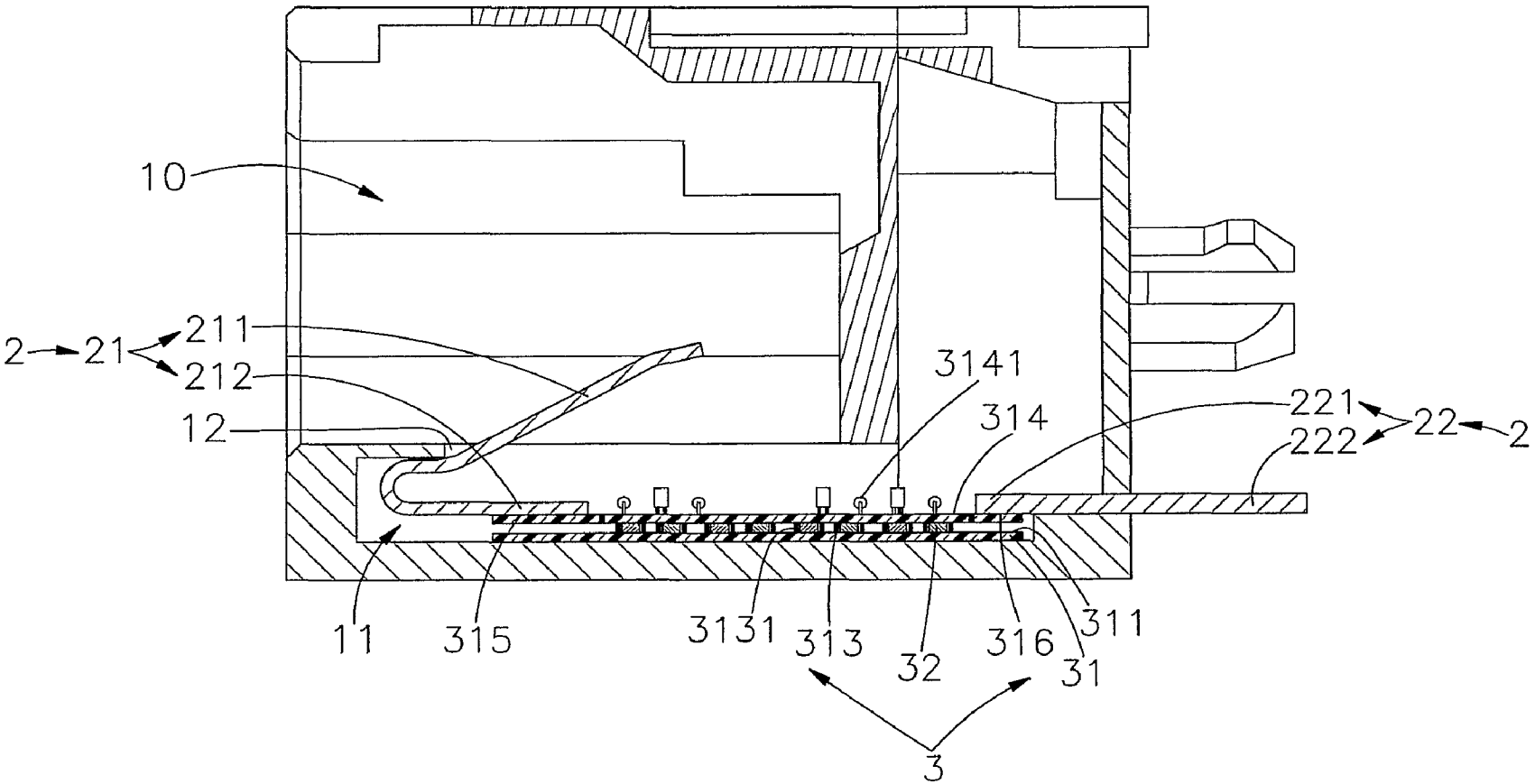
FIG. 3 is a sectional side view of the electronic signal connector in accordance with the present invention.
Figure 4:
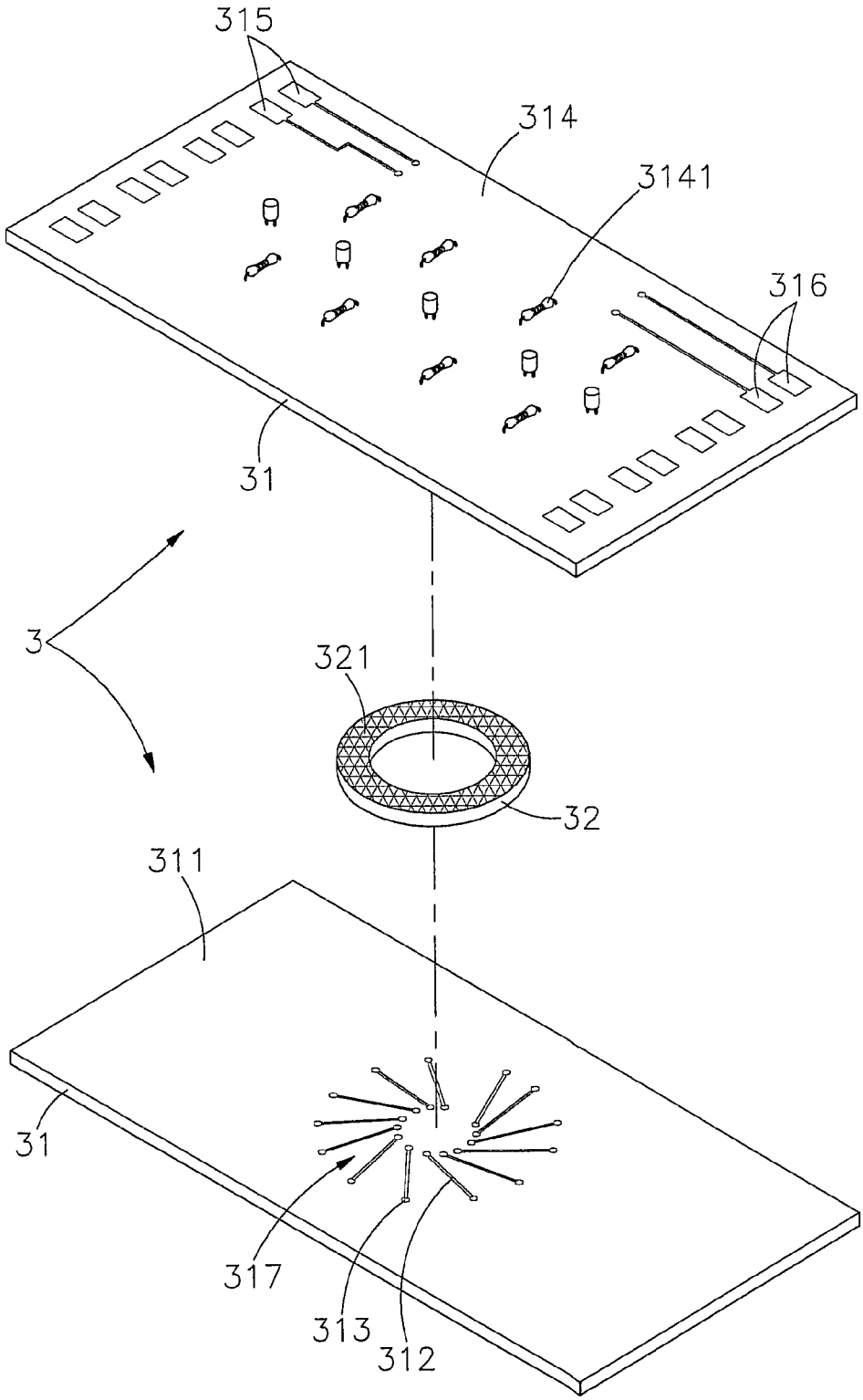
FIG. 4 is an exploded view of the filter module used in the electronic signal connector according to the present invention.

Referring to FIGS. 1~4, an electronic signal connector in accordance with the present invention is shown comprising an electrically insulative housing 1, a metal contact set 2 and a filter module 3.

The electrically insulative housing 1 defines therein a receiving chamber 10, an accommodation chamber 11 in communication with the receiving chamber 10 and a plurality of terminal grooves 12 arranged in a parallel manner in between the receiving chamber 10 and the accommodation chamber 11.

The metal contact set 2 includes a plurality of metal abutting contacts 21 and a plurality of metal transmission contacts 22. Each metal abutting contact 21 has opposing contact end 211 and bonding end 212. Each metal transmission contact 22 has a front bonding end 221 and a rear bonding end 222.

The filter module 3 includes two symmetric flat substrates 31 and a metal core 32. Each flat substrate 31 has an opposing inner surface 311 and outer surface 314. A Metal wire conductors 312 are radially arranged at the center area of the opposing inner surface 311 of each flat substrate 31 at different angles of slope, each having a connection contact 313 at each of the opposing ends thereof. The outer surface 314 of each flat substrate 31 provides a circuit layout having a filter function. The circuit layout is an electric loop consisting of a different electronic components 3141 and filter elements. The metal core 32 is an annular non-crystalline metal core set between the metal wire conductors 312 at the opposing inner surfaces 311 of the flat substrates 31 and bonded thereto with an adhesive 321 (the adhesive can be coated on the metal wire conductors 312 at the opposing inner surfaces 311 of the flat substrates 3 or the two opposing sides of the metal core 32). Thereafter, a solder material 3131 technique is employed to electrically connect the connection contacts 313 of the metal wire conductors 312 at the opposing inner surfaces 311 of the flat substrates 31. Further, a metal input contacts 315 and metal output contacts 316 are respectively arranged on two distal ends of the outer surface 314 of each flat substrate 31 in a respective line and electrically connected with the respective circuit layout.

During installation of the electrical signal connector, bond the bonding ends 212 of the metal abutting contacts 21 of the metal contact set 2 to the metal input contacts 315 of the filter module 3 and the front bonding ends 221 of the metal transmission contacts 22 of the metal contact set 2 to the metal output contacts 316 of the filter module 3, and insert the filter module 3 into the accommodation chamber 11 of the electrically insulative housing 1 to force the metal abutting contacts 21 of the metal contact set 2 into the respective terminal grooves 12 in between the receiving chamber 10 and the accommodation chamber 11 inside the electrically insulative housing 1 to suspend the respective opposing contact ends 211 of the metal abutting contacts 21 in the receiving chamber 10. After installation, the rear bonding end 222 of the metal transmission contacts 22 of the metal contact set 2 are suspending outside the electrically insulative housing 1 for bonding to an external circuit board. It is to be understood that two or more metal cores 32 may be set between the opposing inner surfaces 311 of the flat substrates 31 and electrically connected with one respective set of metal wire conductors 312 at each flat substrate 31.

Further, the electrical signal connector can be any of a variety of network connectors (for example, RJ-45 connector), or male or female type high-frequency connector (for example, USB3.0 connector). Further, as stated above, the bonding ends 212 of the metal abutting contacts 21 of the metal contact set 2 are respectively electrically bonded to the metal input contacts 315 of the filter module 3; the front bonding ends 221 of the metal transmission contacts 22 of the metal contact set 2 are respectively electrically bonded to the metal output contacts 316 of the filter module 3. Thus, input signal is transmitted through t metal abutting contacts 21 of the metal contact set 2 into the metal input contacts 315, and then filtered by the filter module 3, and then transmitted to an external circuit through the metal output contacts 316 of the filter module 3 and the metal transmission contacts 22 of the metal contact set 2. Further, an adapter circuit board may be set in the electrically insulative housing 1 and electrically connected between the bonding ends 212 of the metal abutting contacts 21 of the metal contact set 2 and the metal input contacts 315 of the filter module 3.

Figure 5:
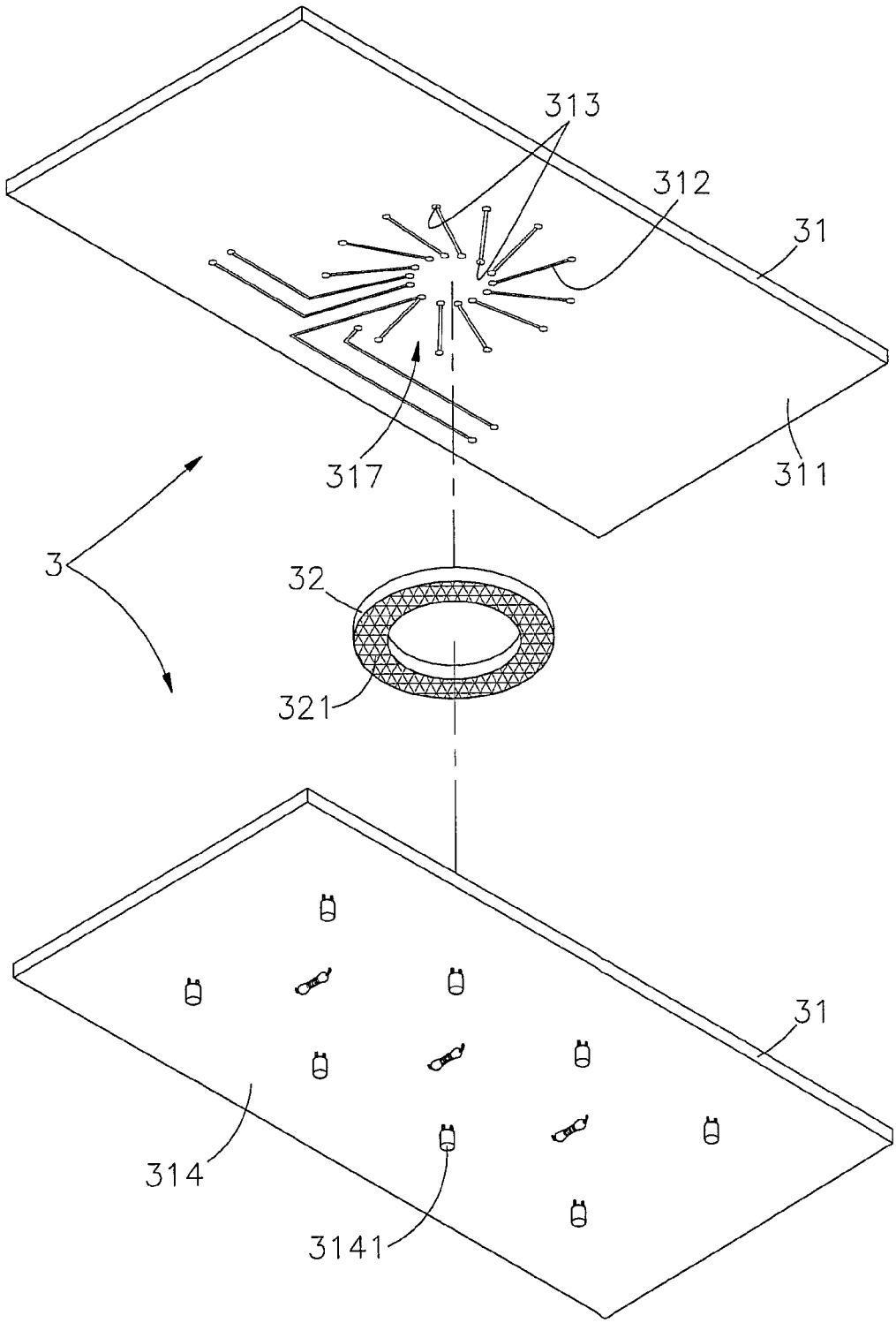
FIG. 5 corresponds to FIG. 4 when viewed from another angle.
Figure 6:
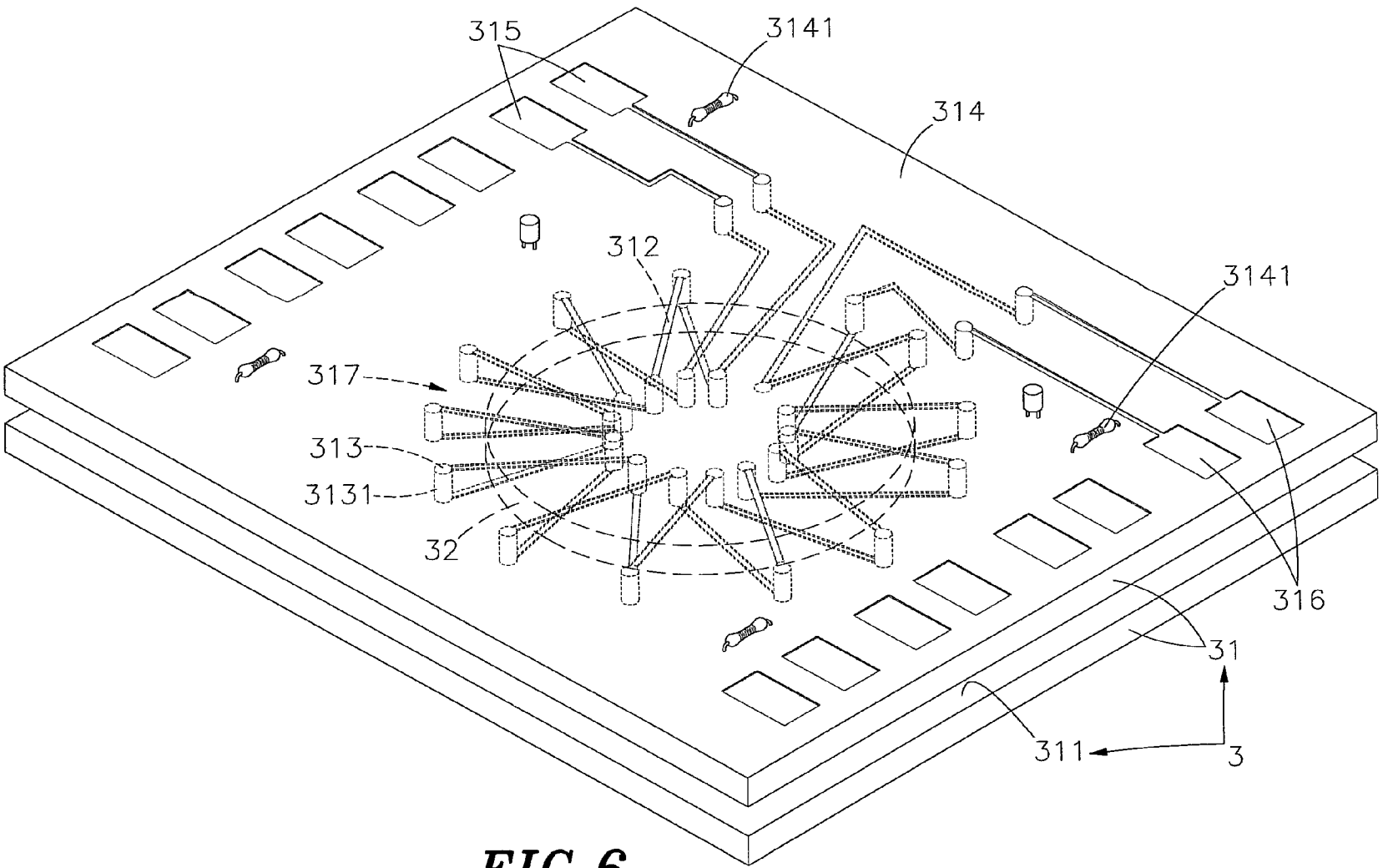
FIG. 6 is a perspective view of the filter module according to the present invention.

Referring to FIGS. 5 and 6 and FIGS. 2 and 4 again, as stated above, the metal core 32 is an annular non-crystalline metal core set between the metal wire conductors 312 at the opposing inner surfaces 311 of the flat substrates 31 and bonded thereto with an adhesive 321, and the connection contacts 313 of the metal wire conductors 312 at the opposing inner surfaces 311 of the flat substrates 31 are respectively electrically connected.

Further, the flat substrates 31 can be regular printed circuit boards or flexible circuit boards. The metal wire conductors 312 can be formed in the opposing inner surfaces 311 of the flat substrates 31 by means of a mechanical process or photolithography technique. After formation of the metal wire conductors 312 in the opposing inner surface 311 of each flat substrate 31, an induction zone 317 is defined between the copper foils at the two flat substrates 31 corresponding to the metal wire conductors 312. Further, two initial ones and two last ones of the connection contacts 313 of the metal wire conductors 312 in the induction zone 317 at the opposing inner surface 311 of each of the flat substrates 31 are respectively electrically connected to respective ones of the metal input contacts 315 and metal output contacts 316 at the outer surface 314 of the respective flat substrates 31.

Further, as stated above, the metal core 32 of the filter module 3 according to the present preferred embodiment is an annular non-crystalline metal core, having a predetermined thickness about 0.025 mm, 0.028 mm or 0.03 mm. The metal core 32 can be made by iron based, iron-nickel based or cobalt based non-crystalline alloy, or iron based bulk nanocrystalline alloy. The annular configuration is not a limitation. Alternatively, the metal core 32 can be made in the shape of a rectangular, polygonal or multilateral open frame.

Figure 7:
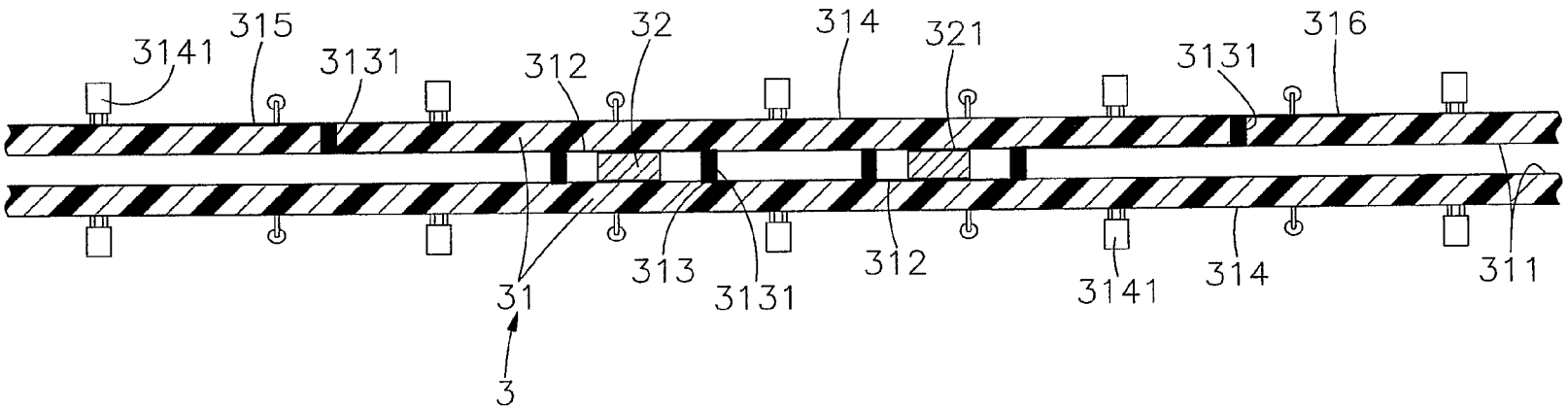
FIG. 7 is a sectional side view of the filter module according to the present invention.
Figure 8:
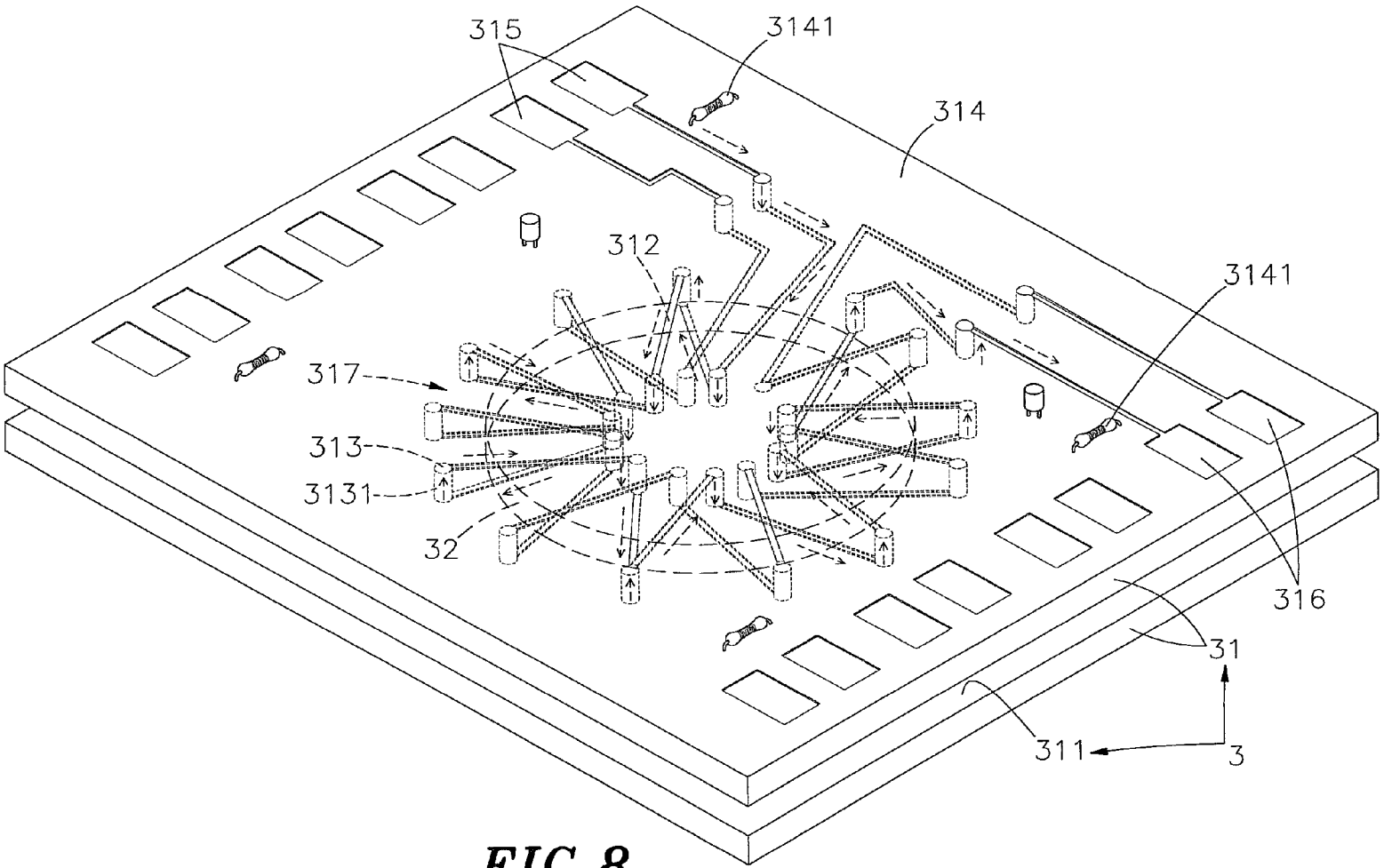
FIG. 8 is another perspective view of the filter module according to the present invention.
Figure 9:
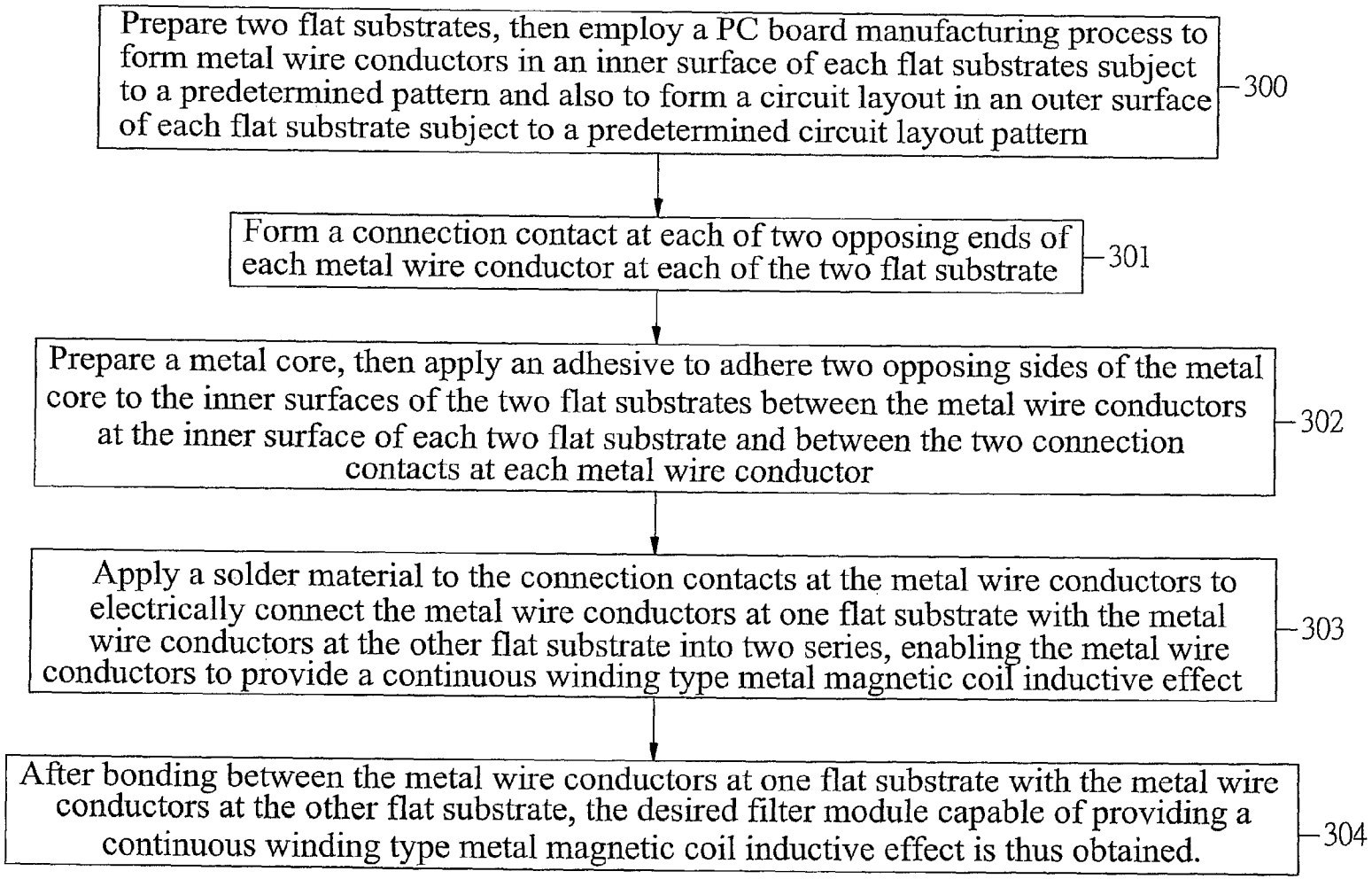
FIG. 9 is a filter module fabrication flow according to the present invention.
Figure 10:
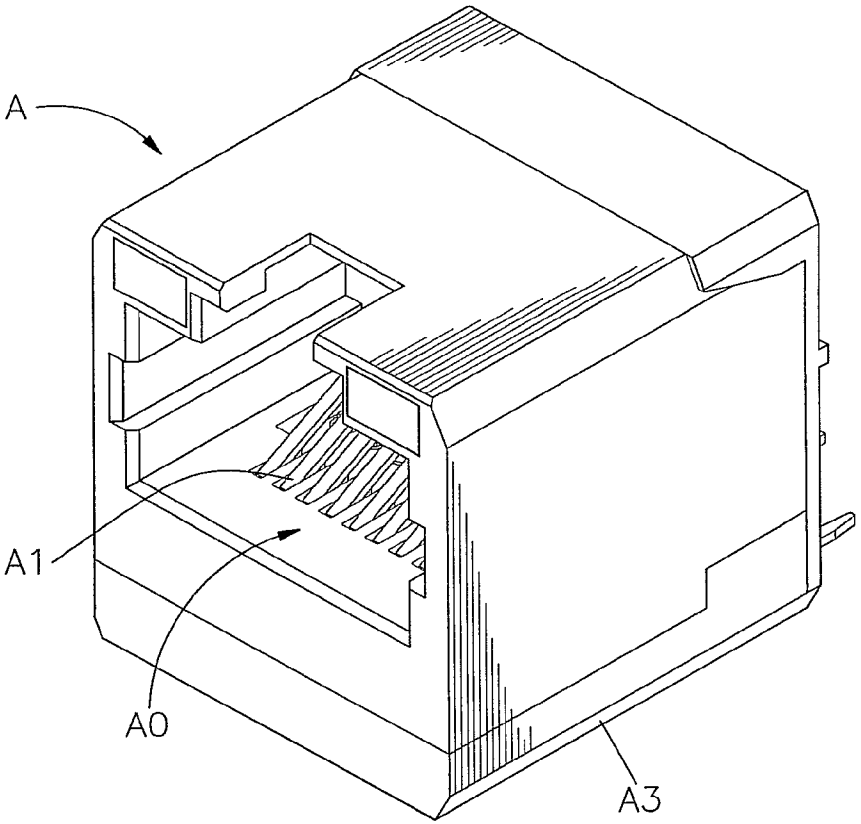
PRIOR ART FIG. 10
FIG. 10 is an elevational view of an electronic signal connector according to the prior art.
Figure 11:
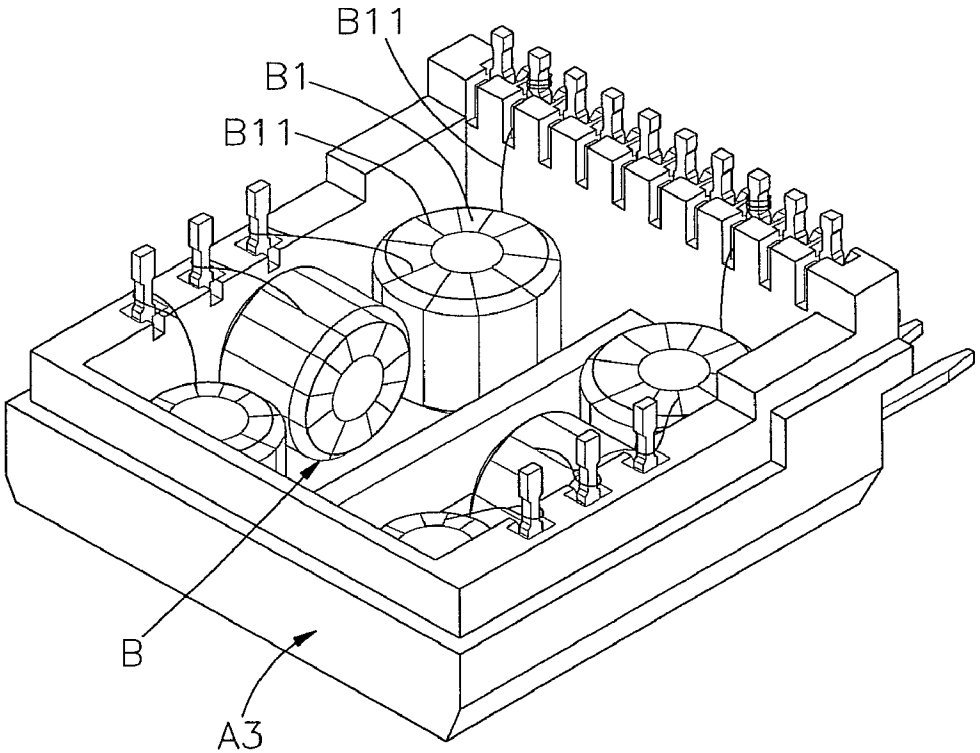
PRIOR ART FIG.11
FIG. 11 is an elevational view of a filter module for electronic signal connector according to the prior art.
Figure 12:
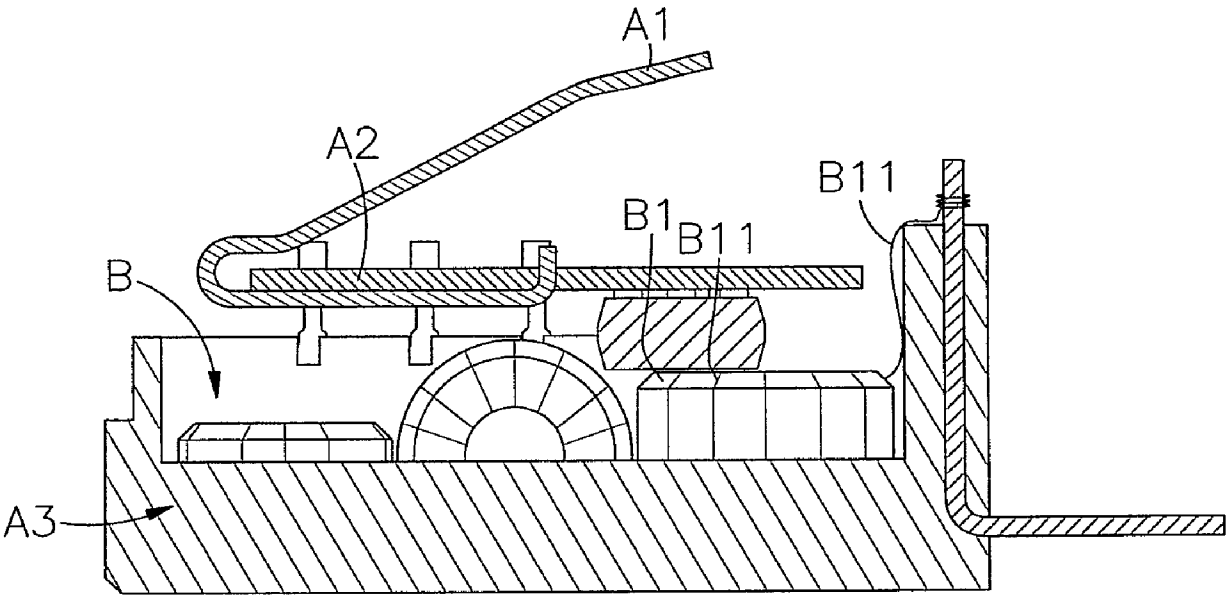
PRIOR ART FIG. 12
FIG. 12 is a sectional side view of the filter module according to the prior art.

Referring to FIGS. 7~9 and FIGS. 2, 4 and 5 again, the filter module 3 is made subject to the following manufacturing steps:

(300) Prepare two flat substrates 31 each having opposing inner surface 311 and outer surface 314, and then employ a PC board manufacturing process including hole drilling, image transfer, plating, etching, anti-soldering and/or surface treatment steps to form metal wire conductors 312 in the opposing inner surface 311 of each of the flat substrates 31 subject to a predetermined pattern for enabling an induction zone 317 to be defined corresponding to the metal wire conductors 312, and also to form a circuit layout consisting of different electronic components 3141, filter elements, metal input contacts 315 and metal output contacts 316 in the outer surface 314 of each flat substrate 31 subject to a predetermined circuit layout pattern.

(301) Form a connection contact 313 at each of the two opposing ends of each of the metal wire conductors 312 at each of the two flat substrates 31.

(302) Prepare a metal core 32, and then apply an adhesive 321 to adhere two opposing sides of the metal core 32 to the opposing inner surfaces 311 of the two flat substrates 31 between the metal wire conductors 312 at the opposing inner surface 311 of each of the two flat substrates 31 and between the two connection contacts 313 at each metal wire conductor 312.

(303) Apply a solder material 3131 (solder paste, solder balls, silver glue) to the connection contacts 313 at the metal wire conductors 312 to electrically connect the metal wire conductors 312 at one flat substrate 31 with the metal wire conductors 312 at the other flat substrate 31 into two series, enabling the metal wire conductors 312 to provide a continuous winding type metal magnetic coil inductive effect.

(304) After bonding between the metal wire conductors 312 at one flat substrate 31 with the metal wire conductors 312 at the other flat substrate 31, the desired filter module 3 capable of providing a continuous winding type metal magnetic coil inductive effect is thus obtained.

Subject to the thin sheet design of the flat substrates 31 and the use of thin thickness metal core 32 and electronic components 3141, the filter module 3 has the characteristics of low profile, excellent induction performance and current rectification performance. For the advantage of space saving, the invention is practical for use in an electronic product having light, thin, short and small characteristics. When an electric current is guided through the input contacts 315 at one flat substrate 31 of the filter module 3, it goes through the connection contacts 313 at the metal wire conductors 312 in the induction zone 317 at one flat substrate 31 and then through the induction zone 317 at the other flat substrate 31 to the respective metal output contacts 316 for output to an external circuit for enabling inductance components to perform charging, discharging, rectifying and chocking operations stably. When an electric current goes through the filter components, the induced magnetic field does not interfere with other surrounding electronic components.

Further, the outer surface 314 of each of the two flat substrates 31 is formed of a copper foil layer. After formation of the designed circuit layout, the copper foil layer of the outer surface 314 of each of the two flat substrates 31 is coated with an insulative resin layer, and then coated with a layer of green color photosensitive lacquer by means of screen printing, curtain coating or electrostatic spraying techniques, and then heat dried and then cooled down, and then radiated by ultraviolet rays in an UV exposure machine under the use of a patterned mask to polymerize the green color photosensitive lacquer. After polymerization of the green color photosensitive lacquer at the outer surface 314 of each of the two flat substrates 31, apply sodium carbonate solution to remove the part of the coating that is not radiated by the ultraviolet rays. Thereafter, apply a high temperature heating process to cure the resin in the green color photosensitive lacquer. Thus, the circuit layout in the outer surface 314 of each of the two flat substrates 31 is well protected against oxidation or accidental short circuit during welding.

In conclusion, the invention provides an electronic signal connector comprising an electrically insulative housing 1, a metal contact set 2, which comprises a plurality of metal abutting contacts 21 arranged in the front side inside the electrically insulative housing 1 for the contacts of respective metal contacts of an external mating electronic signal connector and a plurality of metal transmission contacts 22 arranged the rear side of the electrically insulative housing 1 for bonding to an external circuit, and a filter module 3, which comprises two symmetric flat substrates 31 electrically connected between the metal abutting contacts 21 and metal transmission contacts 22 of the metal contact set 2 and a metal core 32 set between two electrically connected sets of radially arranged metal wire conductors 312 in an induction zone 317 at the flat substrates 31 to provide a continuous winding type metal magnetic coil inductive effect. Thus, the invention has the characteristics of low profile, excellent induction performance and current rectification performance.

During application, the electronic signal connector of the invention has the advantages and features as follows:

1. The filter module 3 has the characteristic of low profile and is electrically connected between the metal abutting contacts 21 and metal transmission contacts 22 of the metal contact set 2 inside the electrically insulative housing 1. Thus, the use of the filter module 3 enables the size of the electronic signal connector to be minimized, facilitating installation and saving much installation labor and time.
2. The non-crystalline metal core 32 is set between the two electrically connected sets of radially arranged metal wire conductors 312 in the induction zone 317 at the flat substrates 31 to provide a continuous winding type metal magnetic coil inductive effect for filtering, rectifying and chocking functions, avoiding interference.
3. The metal core 32 is set between the radially arranged metal wire conductors 312 in the induction zone 317 at the opposing inner surface 311 of each of the flat substrates 31 and bonded thereto with an adhesive 321 to provide a continuous winding type metal magnetic coil inductive effect, eliminating the complicated winding procedure in the fabrication of a prior art filter module using an enabled wire winding technique.
4. Subject to the arrangement of the metal wire conductors 312 and the metal core 32 to provide a continuous winding type metal magnetic coil inductive effect, the filter module 3 eliminates the drawback of complicated winding procedure in the fabrication of a prior art filter module 3 using an enabled wire winding technique and lowers the manufacturing cost.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. An electronic signal connector, comprising:

an electrically insulative housing defining therein an accommodation chamber;

a metal contact set mounted in said accommodation chamber of said electrically insulative housing, said metal contact set comprising a plurality of metal abutting contacts for signal input and a plurality of metal transmission contacts for signal output; and a filter module mounted in said electrically insulative housing, said filter module comprising two symmetric flat substrates electrically connected in parallel between electrically connected between said metal abutting contacts and said metal transmission contacts, each said flat substrate comprising opposing inner surface and outer surface, a set of metal wire conductors radially arranged in said inner surface and electrically connected in series, a circuit layout arranged in said outer surface, a plurality of metal input contacts arranged in a line at one end of said outer surface and electrically connected to said circuit layout and a plurality of metal output contacts arranged in a line at an opposite end of said outer surface and electrically connected to said circuit layout, a solder material set in between said flat substrates to electrically connect the metal wire conductors of said flat substrate in two series, and a metal core bonded to the inner surface of each said flat substrate by an adhesive and set between the metal wire conductors at each said flat substrate.

2. The electronic signal connector as claimed in claim 1, which is configured subject to one of RJ45 and USB3.0 configurations.

3. The electronic signal connector as claimed in claim 1, wherein said electrically insulative housing further defines a receiving chamber in a front side thereof in communication with said accommodation chamber and a plurality of terminal grooves disposed in between said receiving chamber ad said accommodation chamber; said metal abutting contacts are respectively mounted in said terminal grooves, each comprising a front contact end suspending in said receiving chamber and bonding end electrically bonded to one said metal input contact of said filter module; said metal transmission contacts are arranged in a rear side of said accommodation chamber, each comprising a front bonding end electrically bonded to one said metal output contact of said filter module and a rear bonding end suspending outside said electrically insulative housing for bonding to an external circuit.

4. The electronic signal connector as claimed in claim 1, further comprising an adapter circuit board set in said electrically insulative housing and electrically connected between said metal abutting contacts of the metal contact set and said metal input contacts of said filter module.

5. The electronic signal connector as claimed in claim 1, wherein the radially arranged metal wire conductors in the inner surface of each said flat substrate define an induction zone.

6. The electronic signal connector as claimed in claim 5, wherein said metal core is selected from the group of iron based, iron-nickel based and cobalt based non-crystalline alloys and iron based bulk nanocrystalline alloy.

7. The electronic signal connector as claimed in claim 1, wherein said metal core is made in one of the shapes of annular, rectangular, polygonal and multilateral open frames.

8. The electronic signal connector as claimed in claim 1, wherein said adhesive is selected from the group of polymer adhesive, plastic resin glue, chloroprene phenolic adhesive and quick dry adhesive.

9. A filter module fabrication method, comprising the steps of:

(i) preparing two flat substrates each having opposing inner surface and outer surface, and then employing a process to form metal wire conductors in the inner surface of each said flat substrate subject to a predetermined radially extended pattern and to form a circuit layout consisting of different electronic components in the outer surface of each said flat substrate subject to a predetermined circuit layout pattern;

(ii) forming a connection contact at each of two opposing ends of each of the metal wire conductors at each said flat substrate;

(iii) preparing a metal core, and then applying an adhesive to adhere two opposing sides of said metal core to the inner surfaces of said two flat substrates between the metal wire conductors at the inner surface of each said flat substrates and between the two connection contacts at each said metal wire conductor;

(iv) applying a solder material to the connection contacts at said metal wire conductors to electrically connect the metal wire conductors at one said flat substrate with the metal wire conductors at the other said flat substrate into two series, enabling the metal wire conductors to provide a continuous winding type metal magnetic coil inductive effect; and (v) after bonding between the metal wire conductors at one said flat substrate with the metal wire conductors at the other said flat substrate, said flat substrates, said metal wire conductors, said solder material and said metal core constitute a filter module.

10. The filter module fabrication method as claimed in claim 9, wherein the metal wire conductors at said two flat substrates define an induction zone for providing a continuous winding type metal magnetic coil inductive effect.

11. The filter module fabrication method as claimed in claim 10, wherein each said flat substrate defines opposing input side and output side at the outer surface thereof opposite to said induction zone.

12. The filter module fabrication method as claimed in claim 9, wherein said metal core is selected from the group of iron based, iron-nickel based and cobalt based non-crystalline alloys and iron based bulk nanocrystalline alloy; said metal core is made in one of the shapes of annular, rectangular, polygonal and multilateral open frames.

13. The filter module fabrication method as claimed in claim 9, wherein said adhesive is selected from the group of polymer adhesive, plastic resin glue, chloroprene phenolic adhesive and quick dry adhesive.

* * * * *